US008764507B2

(12) United States Patent
Lin

(10) Patent No.: US 8,764,507 B2
(45) Date of Patent: Jul. 1, 2014

(54) LIGHT-EMITTING BUILDING BLOCK HAVING ELECTRICITY CONNECTION UNIT AND POWER SUPPLY BASE FOR THE SAME

(76) Inventor: Chia-Yen Lin, Dongguan (CN)

( * ) Notice: Subject to any disclaimer, the term of this patent is extended or adjusted under 35 U.S.C. 154(b) by 588 days.

(21) Appl. No.: 13/078,991

(22) Filed: Apr. 3, 2011

(65) Prior Publication Data

US 2012/0252307 A1 Oct. 4, 2012

(30) Foreign Application Priority Data

Dec. 31, 2010 (TW) ..... 99147179 A

(51) Int. Cl.
*A63H 33/04* (2006.01)
*A63H 33/08* (2006.01)

(52) U.S. Cl.
CPC ..... *A63H 33/042* (2013.01); *A63H 33/08* (2013.01)
USPC ..... 446/91

(58) Field of Classification Search
USPC ..... 446/61, 85, 91, 117, 124, 128; 439/63
See application file for complete search history.

(56) References Cited

U.S. PATENT DOCUMENTS 3,696,548 A * 10/1972 Teller ..... 446/91
4,743,202 A * 5/1988 Bach ..... 439/53
4,883,440 A 11/1989 Bolli
5,908,328 A 6/1999 Chen
7,846,002 B1 12/2010 Mikesell et al.
2006/0134978 A1 6/2006 Rosen et al.
2009/0047863 A1 2/2009 Capriola

FOREIGN PATENT DOCUMENTS

CN 2320300 Y 5/1999
CN 101820962 A 9/2010
CN 201643724 U 11/2010
KR 20050035986 A 4/2005

OTHER PUBLICATIONS

PCTCN2010080570 International Search Report.

* cited by examiner

*Primary Examiner* — Gene Kim
*Assistant Examiner* — Amir Klayman
(74) *Attorney, Agent, or Firm* — Lin & Associates IP, Inc.

(57) ABSTRACT

A building block includes a hollow brick and a power supply base. The brick has at least two studs extended from a top thereof, at least two tubes corresponding to the studs defined in a bottom thereof and at least two electricity connection units corresponding to the studs disposed therein. The electricity connection unit has a rod connected with a positive conducting member and a negative conducting member. A light member is connected with the positive and negative conducting members. A first positive contact and a second positive contact are respectively located at two ends of the positive conducting member, and a first negative contact and a second negative contact are respectively located at two ends of the negative conducting member. The light member generates light when the bricks are connected to each other by engaging the studs with the tubes.

11 Claims, 9 Drawing Sheets

LIGHT-EMITTING BUILDING BLOCK HAVING ELECTRICITY CONNECTION UNIT AND POWER SUPPLY BASE FOR THE SAME

BACKGROUND OF THE INVENTION

1. Field of the Invention

The present invention relates generally to a light-emitting building block, and in particular to the light-emitting building block having a light member and an electricity connection unit received therein and when multiple building blocks are connected to each other, the electricity connection units are connected to transfer power to the light members.

2. The Prior Arts

Although modern toys or video games provide more vivid entertainment than traditional toys, some traditional toys, such as building blocks, still attract many parents and children. Playing the building blocks can improve hand-eye coordination of young children. Moreover, the building blocks can be assembled and connected in many ways, which is fun. Children and adults both can use bricks in various shapes to create anything and everything, such as vehicles, buildings, and even robots. Therefore, the building block is still one of most popular toys across all ages.

Although the conventional building blocks provide entertainment and stimulate creativity, the building blocks can be improved to attract more children to play. One of schemes to attract attention of the children is to provide a light-emitting building block. The improved building blocks can illuminate when they are connected to each other and still has a structure not too complicated.

SUMMARY OF THE INVENTION

A primary objective of the present invention is to provide a light-emitting building block having a light member and an electricity connection unit received therein. When the building blocks are connected to each other, the electricity connection units form a circuit to supply power to the light members, thereby enhancing entertainment.

In order to achieve the objective, a building block according to the present invention comprises a hollow and light transmittable brick. The brick has at least two studs extended from a top of the brick and at least two tubes corresponding to the studs defined in a bottom of the brick. At least two electricity connection units corresponding to the studs are disposed in the brick and each electricity connection unit has a positive conducting member and a negative conducting member. The positive conducting member has a first positive contact and a second positive contact respectively located at two ends thereof, and the negative conducting member respectively has a first negative contact and a second negative contact located at two ends thereof. At least one light member is disposed in the brick and electrically connected with the electricity connection units. A circuit board is disposed in the brick and the light member is assembled on the circuit board. Each electricity connection unit includes a rod. The positive conducting member and the negative conducting member are connected with the rod, and the positive conducting member is separated from the negative conducting member. The rod passes through the circuit board. Thus, the first positive contact and the second positive contact of the positive conducting member are respectively located at two sides of the circuit board, so that the first positive contact is disposed in the stud and the second positive contact is disposed in the tube. Similarly, the first negative contact and the second negative contact of the negative conducting member are respectively located at two sides of the circuit board, so that the first negative contact is disposed in the stud and the second negative contact is disposed in the tube.

When the bricks are connected to each other by inserting the studs of one brick into the tubes of another brick, the first positive and negative contacts in the studs are in contact with the second positive and negative contacts in the tubes so as to form a circuit. When one of the bricks is electrically connected to a power supply or a power supply is built in the brick, all of the light members in the connected bricks are turned on, which increase the visual attraction.

Another objective of the present invention is to provide a power supply base for supplying power to the building blocks.

The hollow power supply base has at least one stud corresponding to the tube of the brick disposed on a top thereof. The stud of the power supply base has a positive electrode piece and a negative electrode piece. When the power supply base is engaged with the brick, the positive electrode piece and the negative electrode piece are electrically connected with the second positive contact and the second negative contact disposed in the tube of the brick, respectively. The positive electrode piece and the negative electrode piece are electrically connected with at least one battery so as to provide power to the light member in the brick.

The electric power of the battery disposed in the power supply base is transferred to the electricity connection units through the positive and negative electrode pieces so as to illuminate the light members in the bricks.

BRIEF DESCRIPTION OF THE DRAWINGS

The present invention will be apparent to those skilled in the art by reading the following detailed description of a preferred embodiments thereof, with reference to the attached drawings, in which.

DETAILED DESCRIPTION OF THE PREFERRED EMBODIMENT

Figure 1:
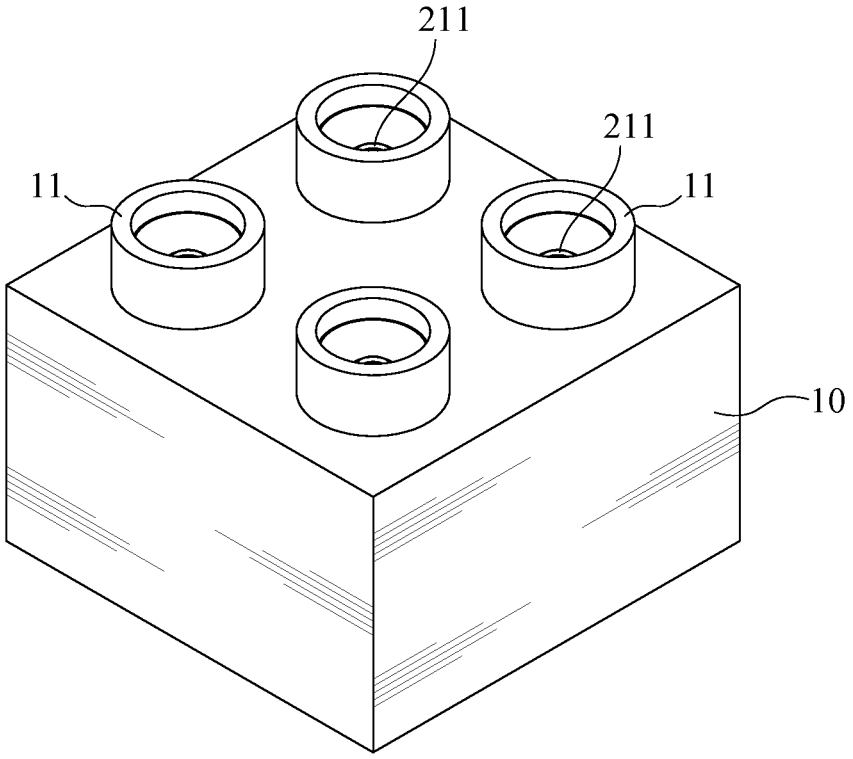
FIG. 1 is a perspective view showing a light-emitting building block in accordance with a first embodiment of the present invention.
Figure 2:
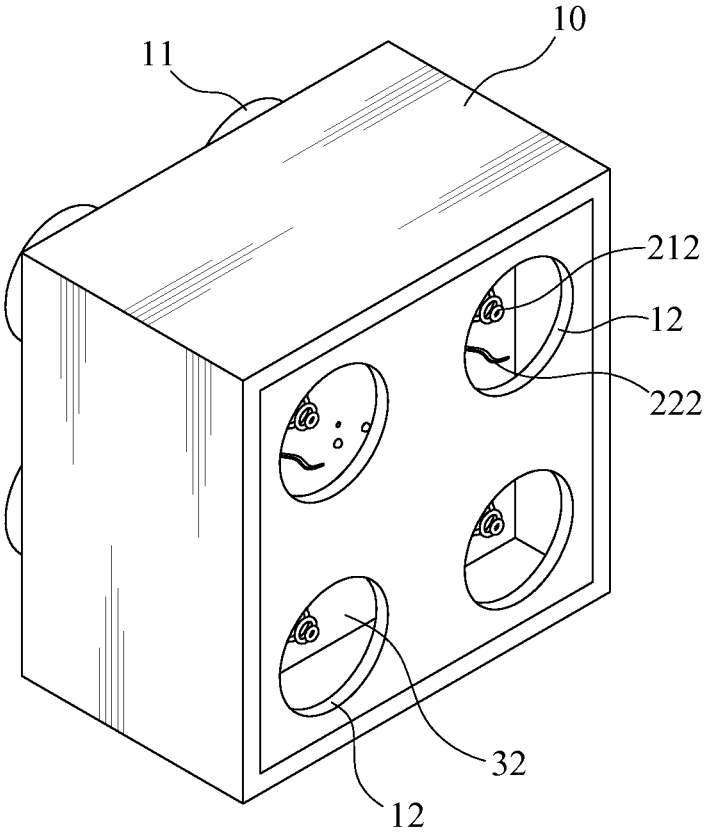
FIG. 2 is another perspective view showing the building block in accordance with the first embodiment of the present invention.

With reference to the drawings and in particular to FIGS. 1 and 2, a light-emitting building block according to a first embodiment of the present invention comprises a hollow and light transmittable brick 10. The rectangular brick 10 has at least two studs 11 extended from a top of the brick 10 and at least two tubes 12 defined in a bottom of the brick 10. The shape, size and the position of the tubes 12 are corresponding to the studs 11. The brick 10 according to the first embodiment has four studs 11 and four tubes 12 arranged in a symmetric form of a 4 by 4 matrix.

Figure 3:
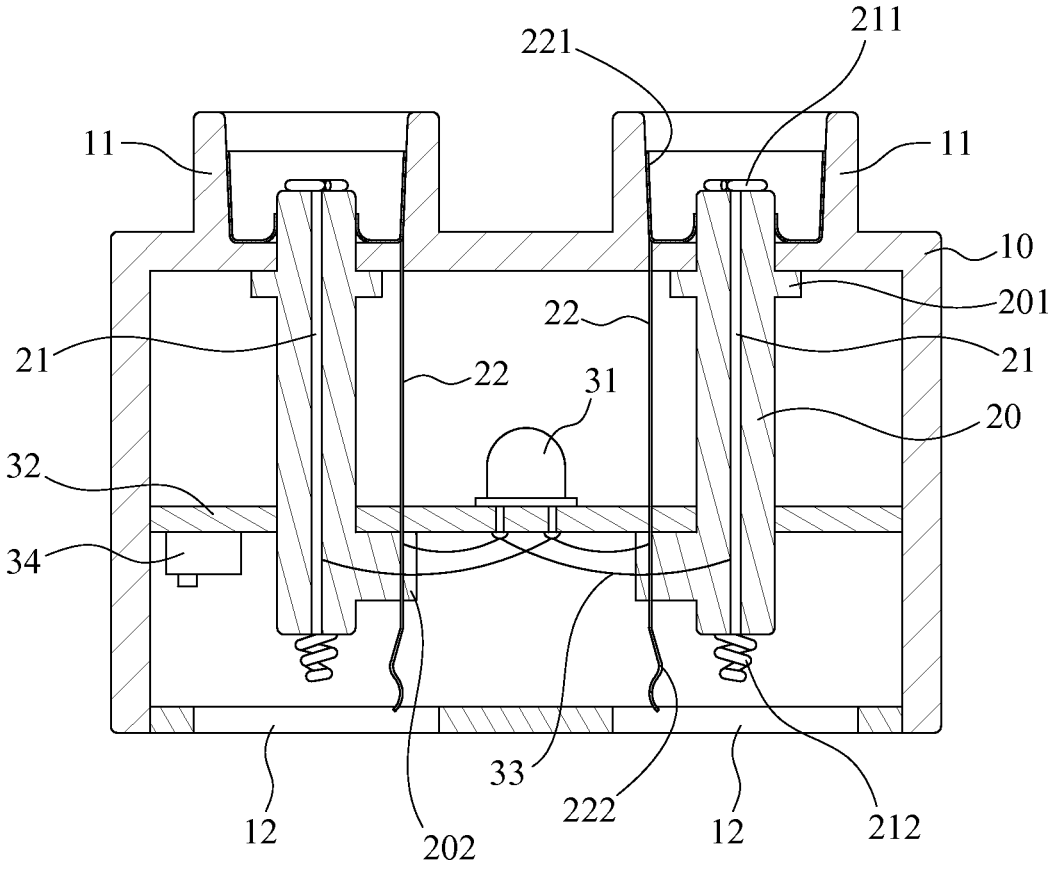
FIG. 3 is a cross-sectional view showing the building block according to the first embodiment of the present invention.

As shown in FIG. 3, at least two electricity connection units are disposed in the brick 10. The number of the electricity connection units is the same as the number of the studs 11 and the positions of the electricity connection units are corresponding to the studs 11, and therefore the brick 10 according to the first embodiment has four electricity connection units received therein. Each electricity connection unit has an insulating rod 20, a positive conducting member 21 disposed inside and extended through the rod 20 and a negative conducting member 22 disposed outside of the rod 20. The rod 20 separates the positive conducting member 21 from the negative conducting member 22, and therefore the positive conducting member 21 is not contacted with the negative conducting member 22. The rod 20 according to the first embodiment includes an upper fixing portion 201 and a lower fixing portion 202 disposed at an upper portion and a lower portion thereof, respectively. An upper end of the rod 20 penetrates through the top of the brick 10 and the disk-shaped upper fixing portion 201 of the rod 20 is contacted with an inner side of the top of the brick 10. The lower fixing portion 202 of the rod 20 extends laterally from an outer surface of the lower portion of the rod 20 so as to fix the negative conducting member 22.

The positive conducting member 21 has a first positive contact 211 and a second positive contact 212 disposed on two ends thereof, respectively. According to the first embodiment, the positive conducting member 21 is a thin rod and is axially disposed in the rod 20. The first positive contact 211 of the positive conducting member 21 is a flat plate and located on a top the rod 20. The second positive contact 212 is shaped in a spiral and protruded out of a bottom of the rod 20 and located in the tube 12.

The negative conducting member 22 has a first negative contact 221 and a second negative contact 222 disposed on two ends thereof, respectively. According to the first embodiment, the negative conducting member 22 is an elongated strip and the first negative contact 221 is shaped in a ring-shaped bowl having a central hole. The ring-shaped bowl of the first negative contact 221 includes an inner wall, an outer wall and a bottom between the inner and outer walls. The inner wall of the first negative contact 221 defines the central hole of the ring-shaped bowl, and is corresponding to and sleeved on the upper end of the rod 20. The outer wall of the first negative contact 221 is corresponding to and contacted with an inside of the stud 11. Because the outer wall of the first negative contact 221 is engaged with the inside of the stud 11 and the inner wall of the first negative contact 221 is sleeved on the upper end of the rod 20, the upper end of the rod 20 is fixed. The second negative contact 222 of the negative conducting member 22 is a flexible bent strip and located in the tube 12 and close to the inner periphery of the tube 12.

Figure 4A:
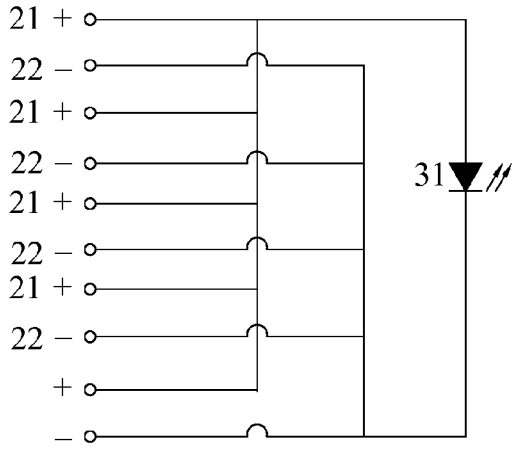
FIGS. 4A to 4C show various connections between electricity connection units and Light Emitting Diodes of the building blocks according to the present invention.

The brick 10 has at least one light member located therein and the light member is electrically connected with the positive and negative conducting members 21, 22. According to the first embodiment, the light member includes a Light Emitting Diode 31 (LED) which is connected to a circuit board 32. The circuit board 32 has more than one set of wires 33 connected to the positive and negative conducting members 21, 22 of the electricity connection units. As shown in FIG. 4A, the positive conducting members 21 are connected in parallel and the negative conducting members 22 are connected in parallel. Then, the parallel-connected positive conducting members 21 and the parallel-connected negative conducting members 22 are connected to the LED on the circuit board 32 in series. Therefore, when any one of the electricity connection units (including the positive and negative conducting members 21, 22) is connected with the power source, the LED 31 on the circuit board 32 is turned on. The rod 20 passes through the circuit board 32.

The positive conducting members 21, the negative conducting members 22 and the LEDs 31 can also be connected by other ways described hereinafter.

Figure 4B:
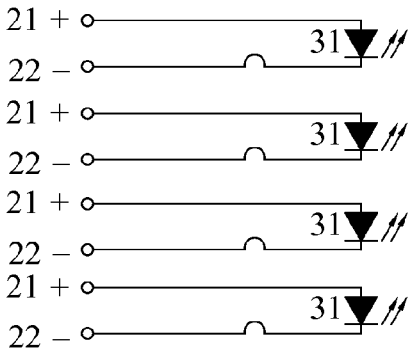

As shown in FIG. 4B, each of the electricity connection units is individually connected with one LED 31. For example, the brick 10 according to the first embodiment includes four electricity connection units and four LEDs 31 disposed in the brick 10. When any of the electricity connection units is connected with the power source, the corresponding LED 31 is turned on.

Figure 4C:
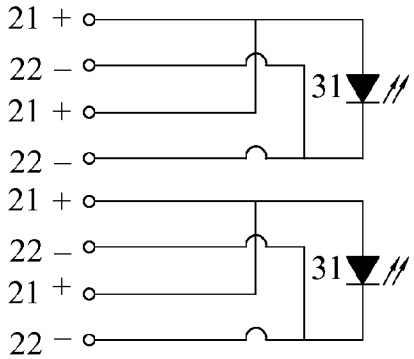

As shown in FIG. 4C, the electricity connection units is arranged in pairs and each pair of the electricity connection units is connected with one LED 31. For example, the four electricity connection units of the brick 10 according to the first embodiment are arranged in two pairs and the brick 10 has two LEDs 31. In each pair of the electricity connection units, the two positive conducting members 21 are connected in parallel, the two negative conducting members 22 are connected in parallel and then the positive and negative conducting members 21, 22 and the LED 31 are connected in series. When the positive and negative conducting members 21, 22 of one of the electricity connection units in the brick 10 are connected with the power source, the corresponding LED 31 is turned on, but the LED 31 connected with the other pair of the electricity connection unit is not turned on.

In order to provide the power to the light members, the brick 10 includes at least one battery (not shown in the drawing) received therein and the battery may be mounted to the circuit board 32. The brick 10 further includes a switch 34 to control the connection between the Light Emitting Diode 31 and the battery. The switch 34 may be disposed at an underside of the circuit board 32 and located corresponding to one of the tubes 12 in the bottom of the brick 10. Therefore, the user can operate the switch 34 through the tube 12.

Figure 5:
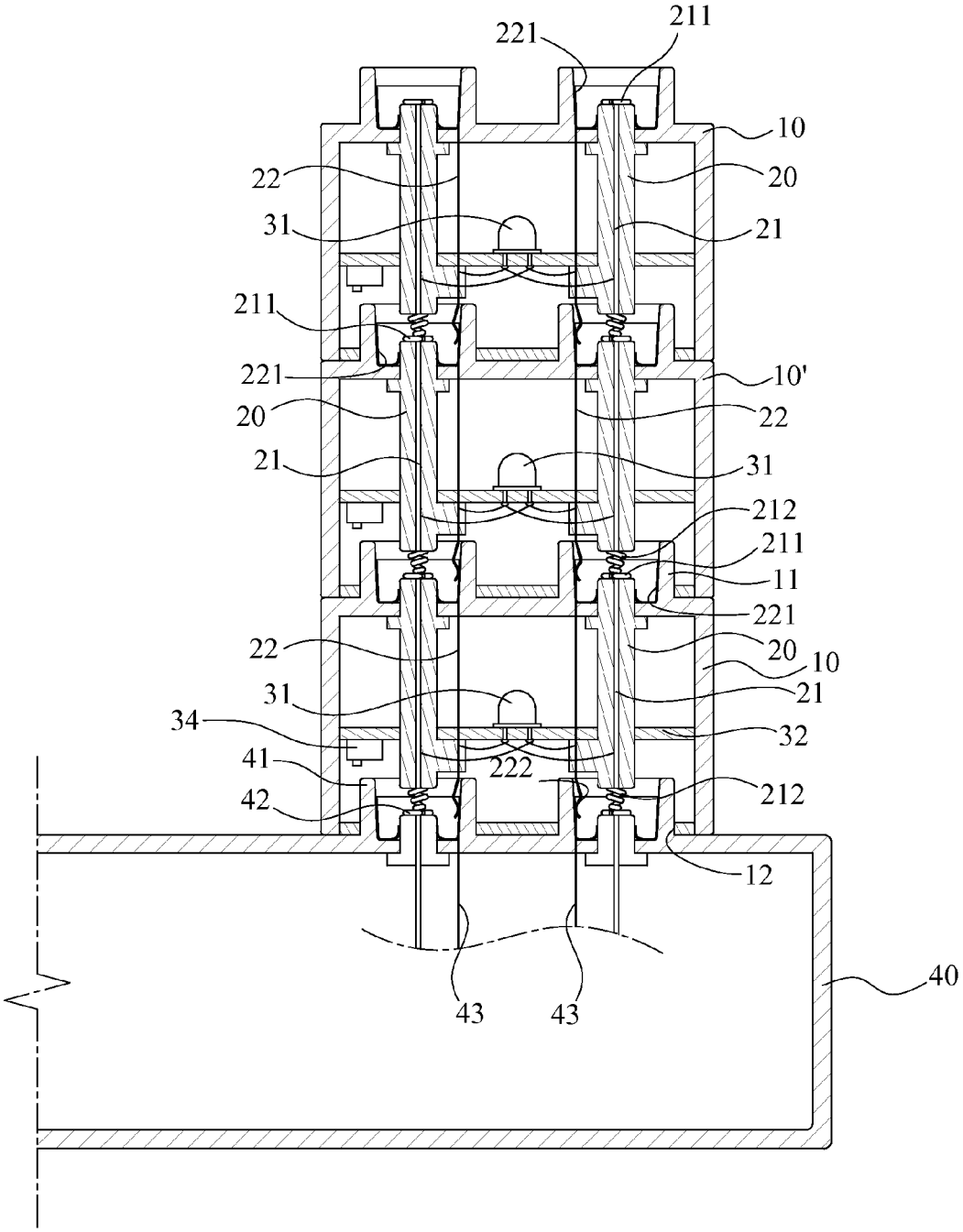
FIG. 5 is a cross sectional view showing the building blocks and a power supply base according to the first embodiment of the present invention connected to each other.

In addition to using the battery disposed in the brick 10 to supply power, the power supply may be disposed outside of the brick 10. According to another embodiment, the brick 10 connects with a power supply base 40 having a structure corresponding to the tubes 12 and the electricity connection units of the brick 10. Referring to FIG. 5, a top of the power supply base 40 includes at least one stud 41 corresponding to the tubes 12 of the brick 10. Each stud 41 of the power supply base 40 has a positive electrode piece 42 and a negative electrode piece 43 disposed therein. The positive electrode piece 42 and the negative electrode piece 43 have structures the same as those of the first positive and negative contacts 211, 221, respectively. The positive electrode piece 42 and the negative electrode piece 43 are connected to at least one battery (not shown in the drawings). When the tubes 12 of the bricks 10 are engaged with the studs 41 of the power supply base 40, the second positive and negative contacts 212, 222 in the tube 12 are electrically contacted with the positive and negative electrode pieces 42, 43 of the power supply base 40, respectively. Therefore, the power supply base 40 provides power to the LEDs 31 in the brick 10 by the positive and negative electrode pieces 42, 43 of the power supply base 40 and the electricity connection units of the brick 10.

Referring to FIG. 5, when the brick 10 is connected with another brick 10', the power supply base 40 supplies power to the LEDs 31 in the brick 10, and also supplies power to the LEDs 31 in the brick 10' through the electricity connection units of the brick 10.

When the bricks 10 and 10' are connected to each other, the studs 11 of one brick are engaged with the tubes 12 of another brick and the electricity connection units of the bricks 10 and 10' are electrically connected. The light members can be turned on to provide the interlocking bricks 10 with the visual attraction.

Figure 6:
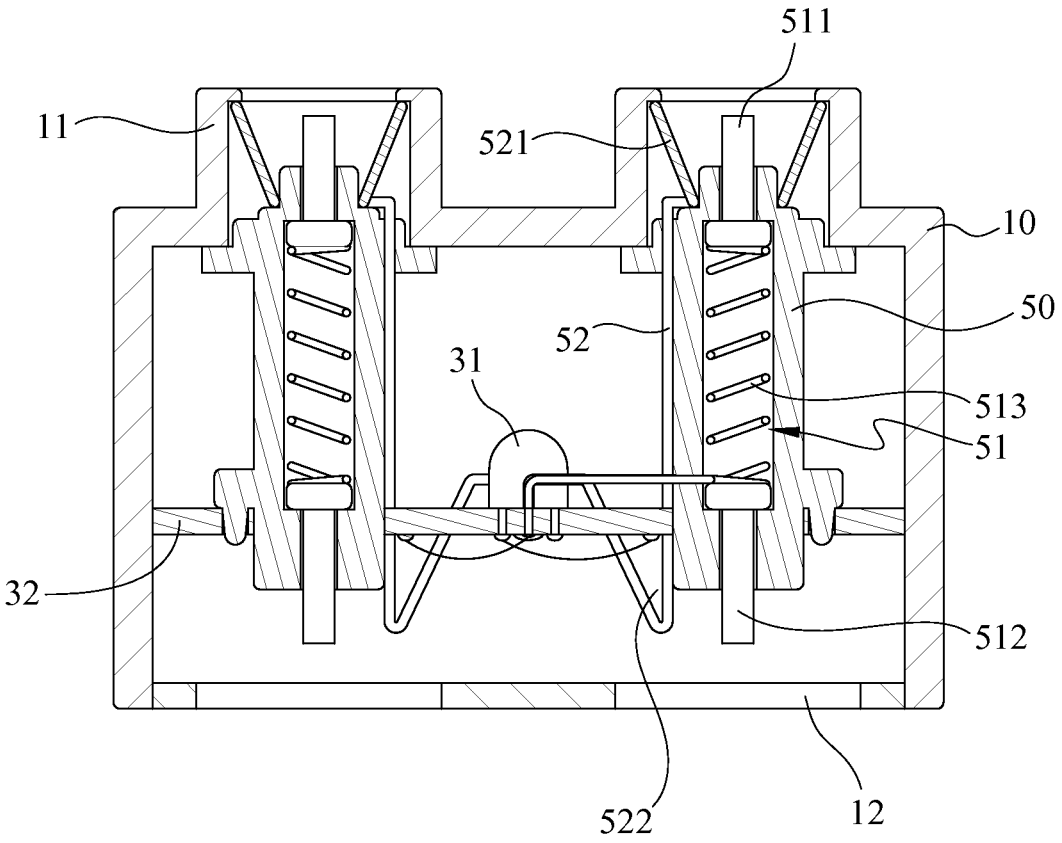
FIG. 6 is a cross-sectional view showing a building block according to a second embodiment of the present invention.
Figure 7:
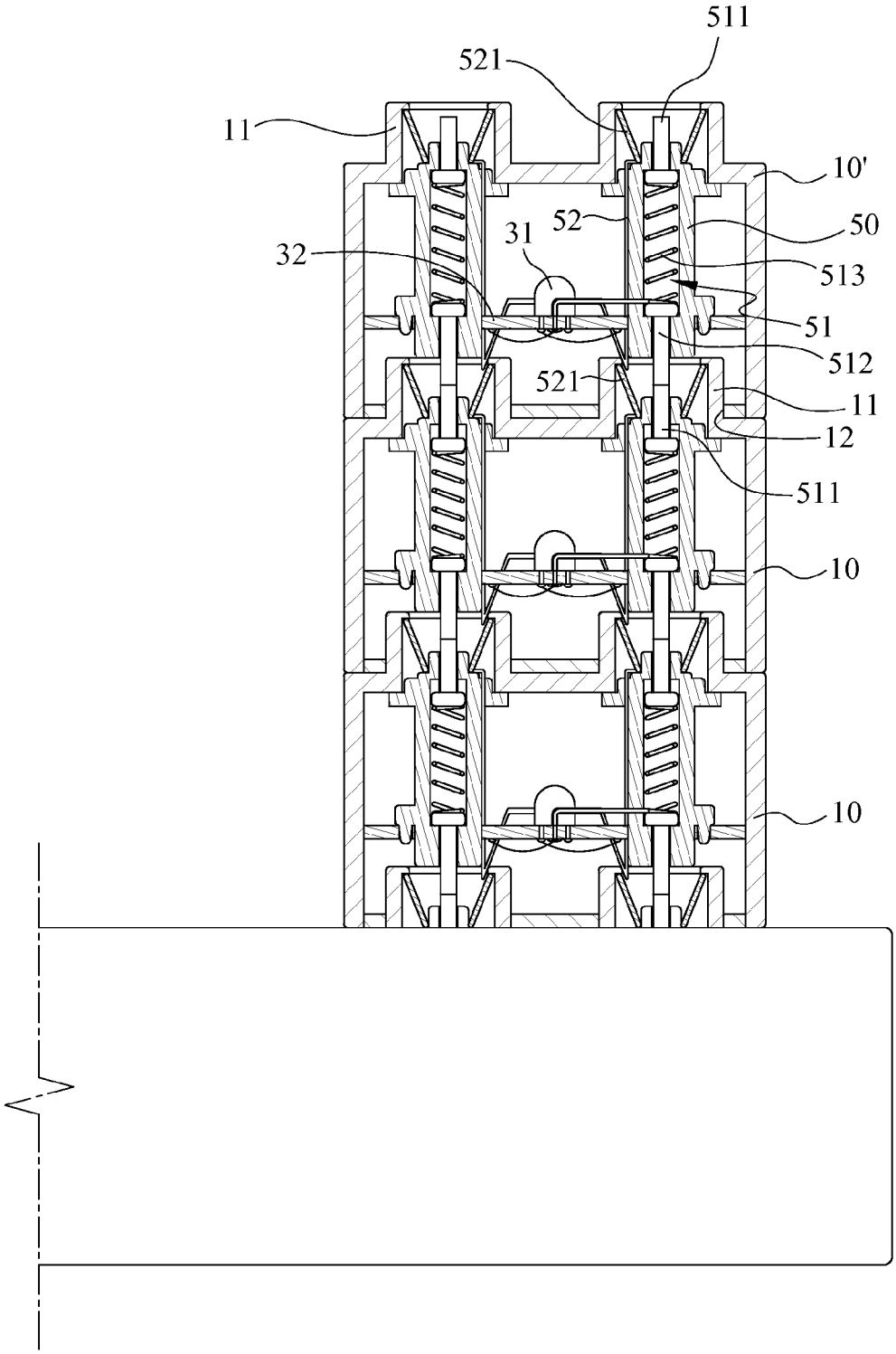
FIG. 7 is a cross sectional view showing the building blocks according to the second embodiment of the present invention connected to each other.

FIGS. 6 and 7 show a brick 10 according to a second embodiment of the present invention, wherein the differences between the first and second embodiments are the forms of the positive and negative conducting members of the electricity connection unit.

The positive conducting member 51 and the negative conducting member 52 of the brick 10 according to the second embodiment are connected to a hollow rod 50. The positive conducting member 51 includes a top contact pin 511, a bottom contact pin 512 and a spring 513 disposed between the top and bottom contact pins 512, 513. Each of the top and bottom contact pins 511, 512 includes a first end and a second end. The first ends of the top and bottom contact pins 511, 512 are projected out of two ends of the rod 50 to form the first and second positive contacts, respectively. The spring 513 is compressed between the second ends of the top and bottom contact pins 511, 512 and therefore the top and bottom contact pins 511, 512 are movable by compressing the spring 513. Moreover, the top and bottom contact pins 511, 512 and the spring 513 form a circuit to be electrically connected with the LED 31.

The negative conducting member 52 includes a first negative contact 521 disposed at a first end thereof. The first negative contact 521 is a conical coil and the diameter of the first negative contact 521 is gradually reduced from top to bottom thereof. The top contact pin 511 is disposed inside of the first negative contact 521. A second end of the negative conducting member 52 is bent to form a flexible second negative contact 522 which is connected with the LED 31 on the circuit board 32 to form a circuit.

The connections of the positive and negative conducting members 51, 52 and the LEDs 31 are the same as those disclosed in FIGS. 4A to 4C.

The same as the first embodiment, when the bricks 10 according to the second embodiment are connected to each other, the tubes 12 of the brick are engaged with the studs 11 of another brick and the bottom contact pin 512 and the second negative contact 522 of the brick are respectively connected with the top contact pin 511 and the first negative contact 521 of another brick. Therefore, the circuit is formed to turn on the LEDs 31.

Figure 8:
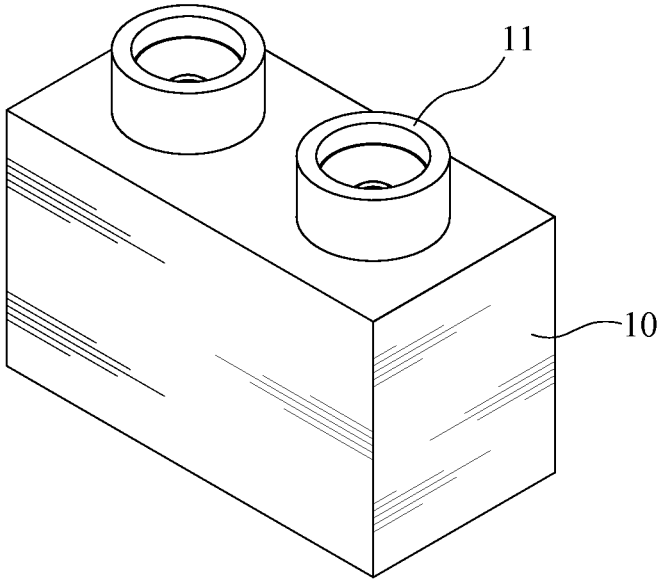
FIG. 8 is a perspective view showing a building block according to a third embodiment of the present invention.
Figure 9:
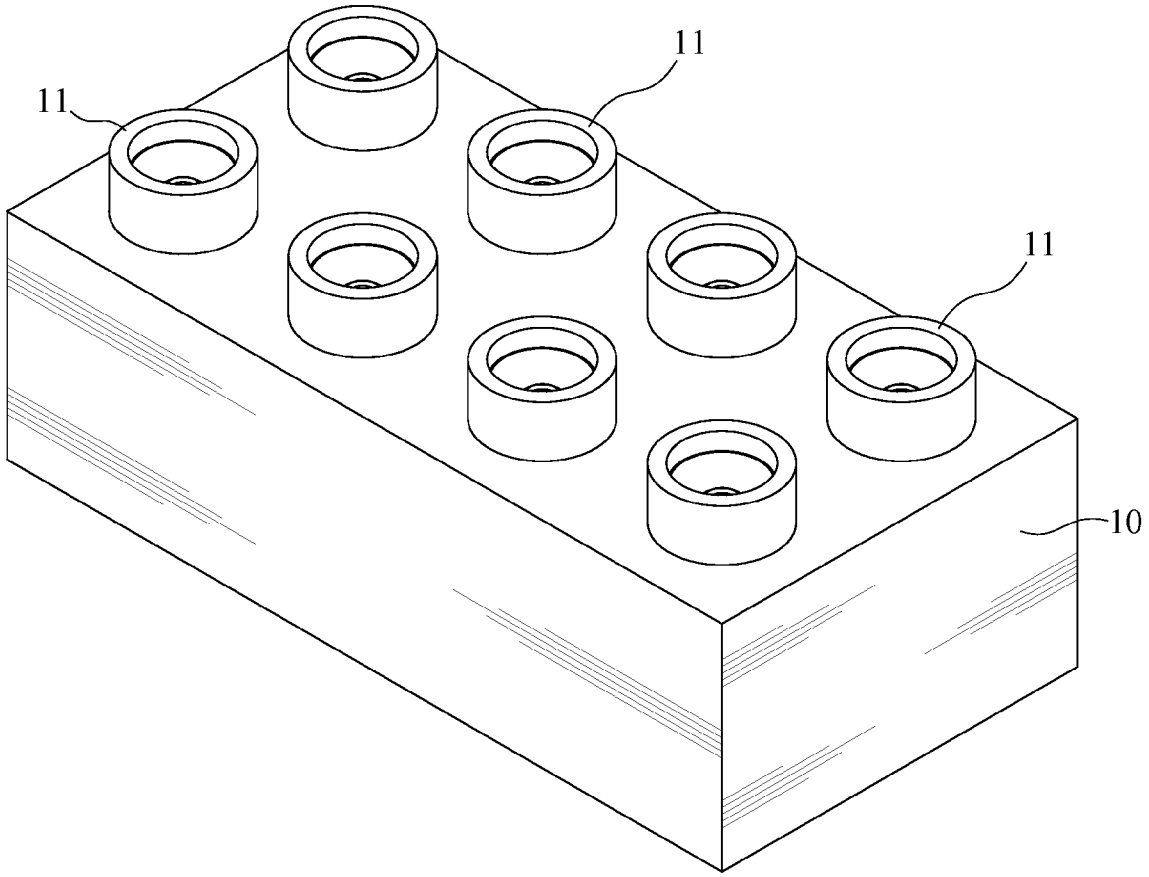
FIG. 9 is a perspective view showing a building block according to a fourth embodiment of the present invention.

The bricks 10 can be rectangular cubes or another shapes of cubes and the number of the studs can also be adjusted. As shown in FIGS. 8 and 9, the brick 10 are rectangular cube having two and eight studs 11 on the top thereof, respectively. The structure inside the brick 10 is the same as the previous embodiments.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A building block, comprising:

a hollow and light transmittable brick, the brick having at least two studs projected from a top of the brick and at least two tubes corresponding to the studs defined in a bottom of the brick;

at least two electricity connection units corresponding to the studs disposed in the brick, each electricity connection unit having a positive conducting member and a negative conducting member separated from the positive conducting member, the positive conducting member respectively having a first positive contact and a second positive contact disposed at two ends thereof, the negative conducting member respectively having a first negative contact and a second negative contact disposed at two ends thereof;

at least one light member disposed in the brick and electrically connected with the positive conducting members and the negative conducting members; and a circuit board, the light member assembled on the circuit board;

wherein each electricity connection unit includes a rod passing through the circuit board, the positive and negative conducting members are connected with the rod, the first and second positive contacts of the positive conducting member are respectively located at two sides of the circuit board so that the first positive contact is disposed in the stud and the second positive contact is disposed in the tube, and the first and second negative contacts of the negative conducting member are respectively located at two sides of the circuit board so that the first negative contact is disposed in the stud and the second negative contact is disposed in the tube.

2. The building block as claimed in claim 1, wherein the first positive contact of the positive conducting member is disposed at a top of the rod and the second positive contact protrudes out of a bottom of the rod.

3. The building block as claimed in claim 2, wherein the first negative contact of the negative conducting member comprises a central hole to sleeve on the top of the rod, and the first negative contact comprises an outer wall which is corresponding to and contacted with an inside of the stud.

4. The building block as claimed in claim 3, wherein the rod of the electricity connection unit comprises an upper fixing portion and a lower fixing portion respectively disposed at a top portion and a bottom portion thereof, the top of the rod penetrates through the top of the brick, the upper fixing portion is shaped in a disk and contacted with an inner side of the top of the brick, and the lower fixing portion extends laterally from the bottom portion of the rod so as to fix the negative conducting member.

5. The building block as claimed in claim 1, wherein the positive conducting member of the electricity connection unit includes a top contact pin, a bottom contact pin and a spring, the top contact pin has a first end extending out of a top of the rod to form the first positive contact and the bottom contact pin has a first end extending out of a bottom of the rod to form the second positive contact, and the spring is disposed and compressed between second ends of the top and bottom contact pins.

6. The building block as claimed in claim 1, wherein a first end of the negative conducting member of the electricity connection unit includes a first negative contact, the first negative contact is a conical coil, a diameter of the first negative contact is gradually reduced from top to bottom thereof, the first positive contact is disposed inside the first negative contact, and a second end of the negative conducting member is bent to form a flexible second negative contact.

7. The building block as claimed in claim 1, wherein the two positive conducting members are connected in parallel, the two negative conducting members are connected in parallel, the positive conducting members and the negative conducting members are electrically connected with the light member, and the light member includes a Light Emitting Diode which is connected to a circuit board.

8. The building block as claimed in claim 1, wherein each electricity connection unit is individually electrically connected with one light member, and the light member includes a Light Emitting Diode which is connected to a circuit board.

9. The building block as claimed in claim 7, wherein the brick includes at least one battery received therein and the circuit board includes a switch at an underside thereof so as to control the electrical connection between the Light Emitting Diode and the battery, and the switch is located corresponding to one of the tubes in the bottom of the brick.

10. The building block as claimed in claim 8, wherein the brick includes at least one battery received therein and the circuit board includes a switch at an underside thereof so as to control the electrical connection between the Light Emitting Diode and the battery, and the switch is located corresponding to one of the tubes in the bottom of the brick.

11. The A hollow power supply base comprising at least one stud corresponding to the tube of the brick as claimed in claim 1, wherein the stud is disposed on a top of the power supply base, the stud comprises a positive electrode piece and a negative electrode piece disposed therein, the positive electrode piece and the negative electrode piece respectively connected with at least one battery, and the positive and negative electrode pieces respectively electrically connect with the second positive and negative contacts.

* * * * *